US007163416B2

(12) United States Patent
Carroll

(10) Patent No.: US 7,163,416 B2
(45) Date of Patent: Jan. 16, 2007

(54) METHOD AND APPARATUS FOR ZONE CABLING

(76) Inventor: James Allen Carroll, 8210 W. 109th St., Bloomington, MN (US) 55438

( * ) Notice: Subject to any disclaimer, the term of this patent is extended or adjusted under 35 U.S.C. 154(b) by 0 days.

(21) Appl. No.: 11/325,595

(22) Filed: Jan. 4, 2006

(65) Prior Publication Data

US 2006/0105613 A1 May 18, 2006

Related U.S. Application Data

(60) Continuation of application No. 11/089,717, filed on Mar. 25, 2005, now Pat. No. 7,014,495, which is a division of application No. 10/686,469, filed on Oct. 15, 2003, now Pat. No. 7,017,267.

(51) Int. Cl.
*H01R 4/24* (2006.01)

(52) U.S. Cl. ..... 439/404; 439/417

(58) Field of Classification Search ..... 439/404, 439/417, 418, 676, 409, 410; 29/861, 865, 29/821

See application file for complete search history.

(56) References Cited

U.S. PATENT DOCUMENTS 4,101,114 A 7/1978 Martin et al.
4,171,123 A 10/1979 Woelkers
4,684,161 A 8/1987 Egner et al.
5,009,612 A 4/1991 Rishworth et al.
5,403,200 A 4/1995 Chen
5,409,397 A 4/1995 Karman
5,431,370 A 7/1995 Veruylen et al.
5,480,203 A 1/1996 Favalora et al.
5,498,172 A 3/1996 Noda
5,505,432 A 4/1996 Noonan
5,538,438 A 7/1996 Orlando
5,624,274 A * 4/1997 Lin ..... 439/417
5,830,005 A 11/1998 Watanabe
5,911,594 A 6/1999 Baker et al.
5,938,181 A 8/1999 Holden
6,019,641 A 2/2000 Kan (Continued)

OTHER PUBLICATIONS

"Zone Cabling: Blending an old idea with new technology"; John C. Leavitt, Nilgun A. Leavitt, Altug Consulting Engineers, and Adrian Zvarych; Jul. 9, 2000.

*Primary Examiner*—Alexander Gilman
(74) *Attorney, Agent, or Firm*—Patterson, Thuente, Skaar & Christensen, P.A.

(57) ABSTRACT

A factory installed wiring guide that guides conductors into position for quality termination and crimp and which provides strain relief (support) for the wires or fibers and the outer sheath of the cable to create a quality cable or sub-cable assembly supporting termination at both ends of the cable. The wiring guide is sized to overcome obstacles and fit into conduits during network wiring installation. The wiring guide may be inserted into a cavity on the backside of a RJ45 female connector, completing the termination of a station cable to a RJ45 female jack. The wiring guide may be installed into a plastic housing creating a RJ45 male connector. The wiring guide may be utilized for multiple connections without damaging or compromising the wiring guide and without the need for cutting the wire from the sub-connector. The wiring guide supports universal attachment to either male or female RJ45 connectors.

14 Claims, 11 Drawing Sheets

U.S. PATENT DOCUMENTS 6,080,007 A 6/2000 Dupuis et al.
6,193,542 B1 2/2001 Marowsky et al.
6,244,906 B1 6/2001 Hashim et al.
6,276,943 B1 8/2001 Boutros et al.
6,280,231 B1 * 8/2001 Nicholls ..... 439/402
6,280,232 B1 8/2001 Beecher et al.
6,328,610 B1 12/2001 Chang
6,332,802 B1 12/2001 Hirokawa
6,370,769 B1 4/2002 Lilienthal, II
6,375,491 B1 4/2002 Durand et al.
6,396,993 B1 5/2002 Giebel et al.
6,398,591 B1 6/2002 Hess et al.
6,402,545 B1 6/2002 Huang
6,402,559 B1 6/2002 Marowsky et al.
6,406,325 B1 6/2002 Chen
6,409,535 B1 6/2002 Marowsky et al.
6,409,539 B1 6/2002 Shi et al.
6,409,548 B1 6/2002 Guttierez
6,409,549 B1 6/2002 Yeh
6,431,918 B1 8/2002 Givens et al.
6,508,677 B1 1/2003 Wang
6,517,386 B1 2/2003 Sakakura et al.
6,729,901 B1 5/2004 Aekins
6,848,947 B1 * 2/2005 Chimiak ..... 439/638
6,966,793 B1 * 11/2005 Brekosky et al. ..... 439/417

* cited by examiner

METHOD AND APPARATUS FOR ZONE CABLING

RELATED APPLICATIONS

This application is a continuation of U.S. patent application Ser. No. 11/089,717, filed Mar. 25, 2005, entitled METHOD AND APPARATUS FOR ZONE CABLING now U.S. Pat. No. 7,014,495 which is a divisional of U.S. patent application Ser. No. 10/686,469, filed Oct. 15, 2003, entitled METHOD AND APPARATUS FOR ZONE CABLING, now U.S. Pat. No. 7,017,267 all of which are incorporated herein in their entirety by reference.

FIELD OF THE INVENTION

The present invention relates to low voltage zone cabling through the use of a pre-terminated zone cables that provide all the advantages of traditional and existing zone cabling methods while minimizing or eliminating the disadvantages of traditional or existing zone cabling methods.

DESCRIPTION OF RELATED ART

Since the early days of telephone systems, the cabling architecture used for premise building wiring was a zone type configuration. Before our modern cubical cities, buildings used an open floor and overlooking managerial office that was combined to allow managers to peer out and watch the staff work. The telephone was the first major communications device commonly distributed to the desktop. Because the facilities themselves hardly changed, cabling was installed using Telephone Terminal Cabinets (TTC's) which were tied back to a Main Distribution Frame (MDF) and associated key systems or patch facilities.

As common office communications grew to include fax machines and data lines (commonly used for computer dial up services), cabling that was once simplistic started to become more complex and difficult to manage. Furniture builders, no longer satisfied with providing desk units, began to produce cubical furniture for open office architecture that allowed for flexibility and a significant cost savings for space allocation. With the advent of Local Area Networks (LAN)/Wide Area Networks (WAN)-technology came deployment of newer cabling technology such as Category-3 (CAT-3), Coaxial (RF) Distribution, Category-5/5e (CAT-5/5e), and Fire-wire. The cabling used to reach from the MDF to the desktop became more and more important.

Communications infrastructure design has now essentially become an art form with as many as six different cables distributed to the desktop. Historically, most building designs, especially older buildings, such as schools and hospitals, did not provide adequate space for cable distribution. In recent years, it was thought that cables should be run directly from the MDF or equipment room to the desktop to reduce splicing and connection losses as cables are stressed to evolving faster network speeds. The Electronics Industry Alliance and Telecommunications Industry Association (EIA and TIA) began to address new requirements for campus premise cabling.

Due to ever-changing technology and the requirements of the cabling infrastructure, buildings now have more bulk weight from cables being run through their floors and ceilings than ever before. The lack of forethought given to cable distribution has made ceiling and floor plenum intertwined nightmares of cable infrastructure. This, compounded with a plethora of moves, additions, and changes (MAC's), has driven the cost of communications higher and higher.

Network cabling may be broken down into the following areas: main technology room (MTR); intermediate technology room (ITR); secondary ITR, zone cabling enclosures; backbone cabling; and station cabling.

The Main Technology Room (MTR) traditionally supports the file servers and implemented technologies. All backbone cables (copper and fiber) supporting voice and data technologies connect the MTR to multiple Intermediate Technology Rooms (ITR's). Occasionally, the MTR may support station cables (voice and data) installed within this room or returning to this room.

The intermediate technology room (ITR) traditionally supports star equipment technology (routers, hubs, and etc.), backbone cabling (copper and or fiber), station cabling, voice, and data, out to each workstation. Equipment and patch panels for data applications may be mounted onto racks. Voice equipment and voice applications traditionally may be mounted to the wall.

The consolidation point, secondary ITR, is where zone cabling solutions may be implemented, and consolidation points or secondary ITR may be incorporated into the design. Backbone cables (copper and fiber) may be installed in the ceiling riser shaft and connect the MTR to the ITR's. Data applications over copper wire generally have a total distance limitation of approximately 327 feet. This maximum distance includes the use of all patch cables. Typically all data applications on copper wire should be limited to a horizontal and vertical distance of 327 feet or 100 meters.

Voice applications over copper have fewer distance restrictions and can support distances of 2500 feet or greater. Fiber may be utilized for data application when distances exceed 100 meters. Fiber may be utilized for voice applications when the application requires it. Station workstation cables generally consist of at least one voice cable and at least one data cable.

In traditional cable installation, the station cable may be installed from the ITR or the MTR to each workstation location (furniture partition and or hard wall office), in a continuous run, i.e., without splices or breaks in the cable. The station cable may be pulled to length from 1000 feet cable spools, cut, and dressed to length. Each individual conductor may be terminated at the MTR or the ITR on a patch panel (data cable) or a station block (voice cable).

The station cable at the workstation side may either be dressed down a power pole and dressed into the wire management within the furniture partition or dressed up through a floor panel and into the wire management in the furniture partition. The station cables may be field terminated onto RJ45 female jacks and placed into a furniture partition faceplate.

Station locations in hard wall offices route the cable down the wall via pull string, conduit and box attached to the stud wall. Station cable conductors may be field terminated onto a RJ45 female jack or other generally recognized network connector with RJ45 being used as a representative only. The RJ45 female jack may then be placed into a faceplate and screwed into the conduit box.

A disadvantage of this cable installation method is that all cable must be installed as a home run (continuous from the ITR to the station location). When furniture partitions are moved, existing cables need to be cut from the RJ45 female jacks, pulled back into the ceiling before the furniture partitions can be broken down and reconfigured. Occasionally, existing cables may be re-worked and re-used. If existing cables cannot be re-used, these cables, by code, must be removed from the ceiling.

The majority of station cables typically are abandoned and must be removed. New station cables must be installed from the ITR to the new station locations. Sometimes these distances are 275 feet or greater. The cost a company incurs in the renovation may be at least threefold. First, there is the cost of labor to remove the abandoned cable. Second, there is the cost of wasting perfectly good cable that is just difficult to re-use. And third, there is the cost of labor and material to install new cable from the ITR to the new station location. Much of the cabling work must be completed after normal business hours, or on weekends, and paid at overtime rates, in an attempt to reduce employee down time resulting in delays and lost productivity in the work place.

When companies reconfigure their modular furniture, the cost to wire their facility is expensive because of the limited flexibility of moving or re-using existing home run cables.

Existing zone cabling solutions provide for an additional termination and patching point in the cabling solution. The previous zone approach allowed for remote patching in at least one of the two areas: raised floor and/or ceiling.

A zone cable solution, which utilizes a raised floor method, requires the client to install consolidation points, that is, distribution boxes strategically placed throughout the facility underneath the raised floor. The raised floor may be 4 to 6 inches in height. The raised floor may be installed throughout the majority of the office facility. Modular furniture and offices may be installed on top of the raised floor. Station cable may be installed in large quantities from the MTR and/or the ITR to the consolidation point box enclosures. The consolidation point box enclosures may be a termination point (extension of the MTR and ITR patch panels out to the floor). The consolidation points ordinarily remain permanently fixed. Station cable may be installed from these consolidation point box enclosures to workstations. In some cases, a long patch cable (RJ45 male to RJ45 male patch cable) may be installed from the consolidation point distribution box to the workstation to support voice and data devices.

An alternative to patch cord connection may be a cable extension to the workstation where the cable may be terminated at the workstation end onto a RJ45 female jack. Patch cables may be extended from this female jack to communications devices.

Raised floor panels may be opened to accommodate future MAC's (moves, additions, and changes) in the cabling infrastructure. If a reconfiguration in furniture is required, only the station cable or patch cord from the consolidation point distribution box to the workstation may be necessary to be moved or replaced. This results in a cost savings because the company is only replacing or reconfiguring the last 50 feet of cable instead of the total run of 250–300 feet of station cable.

A disadvantage of raised floor zone cable solutions is the cost to install raised floors throughout a company's facility. Few companies can justify the expense or return on investment unless they own their own facility.

Another disadvantage is that the installation of zone cable from the MTR and/or the ITR to the consolidation point distribution box may be accomplished by setting up multiple 1000-foot spools of 4 pair cable. The cables may be pulled to length, cut, dressed into the zone distribution box and then dressed into the ITR. The cables may be dressed back to freestanding racks and into the patch panels. Each cable may be dressed to the termination point at the back of the patch panel at both ends of the cable. The cable may be stripped back and the pairs carefully separated, placed onto the back of the patch panel and terminated. Each individual conductor must be properly placed, terminated, and tested.

The most time consuming part of a cable installation is separation, placement, and termination of cable. Utilization of a zone distribution alternative at least doubles the number of station cable terminations resulting in additional trouble points, increasing labor field costs, and increases the cost of materials, the number of zone distribution boxes, patch panels, and patch cords, along with the associated labor to install these items.

Additionally, raised flooring tile may be difficult to access for MAC work. It may require the removal of carpet tiles (which may overlay floor tiles), furniture, filing cabinets, and modular furniture may also need to be moved to gain access where required. Finally, raised floor tiles typically require the removal of at least 4 screws that hold each tile to the base.

Another disadvantage is that all terminations performed in the field are performed by numerous various installers, resulting in dissimilar connections, and leading to problems such as near end cross talk and signal impairment.

Ceiling zone distribution systems are configured and installed similar to a raised floor zone system. Multiple cable spools of 1000 feet may be set up and cable pulled to length, cut, and terminated in a ceiling consolidation point box enclosure. Station cable ports may be located throughout the ceiling and be available to support a given area within an office. The final fifty feet or so of station cable installation may be installed from the distribution panel to a workstation, down through a power pole, and into spaces provided in modular furniture, or up through a floor plenum and into the furniture partition. Once the cables are dressed into the furniture workstation, the cables may be terminated in each cubical onto an RJ45 female jack and tested.

The ceiling zone cabling solutions suffers some of the same disadvantages as the raised floor solution.

Another significant disadvantage of network cabling is that the cables come from the manufacturer without connective ends. Connective ends, such as the RJ45 connector are too large to fit through obstacles, conduits, face plates, and etc. and the release clip on a RJ45 male connector gets caught on obstacles causing damage to the RJ45 male connector.

There is a need for a sub-connector attached to cables at the factory. The sub-connectors need to be small enough to fit through common obstacles encountered during a network wiring installation. The sub-connectors should be adapted to operatively connect to a corresponding connector of the type commonly used in the wiring industry. The cables should be provided with a sub-connector at both ends thereof and when manufactured could be considered sub-patch connector cables, in contrast to patch cables provided with standard RJ45 connectors, such as those removed from buildings during MAC's. The sub-connectors should provide strain relief to prevent wires or fibers from becoming dislodged from the sub-connector during the cable installation process.

It can be seen that there is a need for a factory installed wiring guide, or wiring cage sub-connector attached to cable ends to permit proper positioning of conductors. The factory installed wiring guide needs to provide a quality termination and crimp to the cable that provides strain relief/support for the wires or fibers and the outer sheath of the cable.

It can be seen there is a need for a prefabricated cable provided with a wiring guide sub-connector having a size sufficient to fit into small cable conduits and modular furniture electrical openings. The wiring guide should be adapted to be insertable into a backside of an RJ45 female connector to complete termination of a station cable.

It can be seen there is a need for a prefabricated cable having a wiring guide connectable to an RJ45 female connector that permits the wiring guide of the cable to be inserted (installed) and removed (de-installed) a plurality of times into and out of an RJ45 connector. The wiring guide may be provided to connect a cable to either a male or female RJ45 connector.

It can be seen that there is a need for a zone cabling system that minimizes additional up front costs to install a network zone cabling system. It can also be seen that there is a need for a zone cabling system that eliminates field terminations and results in more consistent high quality connection/termination of jacks at the workstation, the consolidation point distribution panel, the main technology room and the intermediate technology room.

It can also be seen that there is a need for a zone cabling system that reduces labor cost to install zone cables with multiple setups on spools that are an exact length required from the main technology room or the intermediate technology room to the consolidation point distribution panel. It can also be seen that there is a need for a zone cabling system where no field termination is required and only the insertion of the wire guide and sub-connector combination into the back cavity of the RJ45 female connector is necessary.

It can also be seen that there is a need for a zone cabling system that provides flexibility to quickly reconfigure an office or modular furniture area. It can also be seen that there is a need for a zone cabling system that reduces labor costs labor future moves, additions and changes, (i.e. during original installation and labor cost for future) when only the last 25–75 feet of station cable has to be reconfigured.

It can also be seen that there is a need for a zone cabling system that reduces cost for materials because the station cable (sub-cable from consolidation point panel to workstation) can be used again and again. It can also be seen that there is a need for a zone cabling solution that provides marginal increased cost to make cable assemblies from lower cost labor pool versus offset by the higher labor cost savings in the field because of reduced installation and termination time.

It can also be seen that there is a need for a zone cabling system that provides manufacturer test results in the factory instead of or in addition to field testing, potentially resulting in time saved over mere field certification. The present invention fulfills these and other needs, and addresses other deficiencies of prior art implementations.

SUMMARY OF THE INVENTION

To overcome limitations in the prior art described above, and to overcome other limitations that will become apparent upon reading and understanding the present specification, the present invention discloses a factory installed and/or field installable wiring guide or wiring cage sub connector that guides conductors into position for quality termination and/or crimp and which provides strain relief (support) for the wires or fibers and the outer sheath of the cable to create a quality cable or sub-cable assembly supporting termination at both ends of the cable. The wiring guide or wiring cage sub-connector can be inserted into a cavity on the backside of a RJ45 female connector (or a RJ45 male connector,) completing the termination of a station cable to a RJ45 (male or) female jack assembly.

(Another object of the present invention is that the wiring guide may be installed into a plastic housing creating a RJ45 male connector.) The wiring guide may be utilized for single or multiple connections without damaging or compromising the wiring guide and without the need for cutting the wire from the connector while providing strain relief for the wires or fibers and the outer sheath of the cable. (The wiring guide supports universal attachment to either male or female RJ45 connectors.)

A method in accordance with the principles of the present invention may include a method of network wiring installation including assembling a prefabricated network cable or bundle of cables. The network cable may include a plurality of conductors. The method may also include configuring sub-components to have a size adapted to permit the sub-components to overcome obstacles and traverse conduits encountered during network wiring installation.

The method may also include affixing a first sub-component to the plurality of conductors at a first end of the cable and affixing a second sub-component to the plurality of conductors at a second end of the cable. The method may also include running the cable along a continuous path through encountered obstacles and conduits between first and second network interfaces and deploying the ends of the cable proximate the respective interfaces.

The method may also include joining the first sub-component in conductive connection to a first network component associated with the first network interface and joining the second sub-component in conductive connection to a second network component associated with the second network interface. The method may also include establishing communication between the first and second network interfaces.

Other embodiments of a method in accordance with the principles of the invention may include alternative or optional additional aspects. One such additional aspect of the present invention is that the shielded conductors may be copper wires.

Another additional aspect of the present invention is that the conductors may be optical fibers.

Another additional aspect of the present invention is that the sub-component may be a wire guide. The method may also include joining the wire guide and a wire guide cap. The wire guide cap may have conducting teeth. The method may also include operatively connecting the conductors with the conducting teeth and forming a conductive connection between the wire guide and the wire guide cap.

Another additional aspect of the present invention is that the network components are RJ45 connectors and the sub-components are operatively connected to the RJ45 connectors.

Another additional aspect of the present invention is that the network interfaces are patch panels forming network hubs.

Another additional aspect of the present invention is that the network interfaces are a patch panel and a network terminal device.

Another additional aspect of the present invention is that the sub-components are adapted for reuse with a plurality of conducting components.

Another method in accordance with the principles of the present invention may include a method of network wiring installation including assembling prefabricated network cables. The network cables may each include a plurality of conductors. The method may also include forming a network cable bundle including a plurality of network cables consolidated within a casing.

The method may also include configuring sub-components to have a size adapted to permit the sub-components to overcome obstacles and traverse conduits encountered during network wiring installation. The method may also include affixing a first sub-component to the plurality of conductors at a first end of each of the cables and affixing a second sub-component to the plurality of conductors at a second end of each of the cables. The method may also include running the bundle between first and second network interfaces.

The method may also include running a portion of each cable through obstacles and conduits and proximate the network interfaces. The method may also include joining the first sub-component of each cable in conductive connection to a respective network component associated with the first network interface and joining the second sub-component of each cable in conductive connection to a respective second network component associated with the second network interface. The method may also include establishing a plurality of communication pathways between the first and second network interfaces.

Another aspect of the present invention is that the conductors are shielded copper wires.

Another aspect of the present invention is that the conductors are optical fibers.

Another aspect of the present invention is that the sub-component is a wire guide. The method may also include joining each wire guide to a wire guide cap. The wire guide cap may have conducting teeth. The method may also include operatively contacting the conductors with the conducting teeth and forming a conductive connection between each wire guide and each wire guide cap.

Another aspect of the present invention is that the network components are RJ45 connectors and the sub-components are operatively connected to the RJ45 connectors.

Another aspect of the present invention is that the network interfaces are patch panels forming network hubs.

Another aspect of the present invention is that the network interfaces are a patch panel and a plurality network terminal devices.

Another aspect of the present invention is that the sub-components are adapted for reuse with a plurality of components.

Another method in accordance with the principles of the present invention is a method of network wiring installation including assembling prefabricated network cables. The network cables each including a plurality of conductors. The method also includes forming a network cable bundle including a plurality of network cables consolidated within a casing and configuring sub-components to have a size adapted to permit the sub-components to overcome obstacles and traverse conduits encountered during network wiring installation.

The method also includes affixing a first sub-component to the plurality of conductors at a first end of each of the cables and affixing a second sub-component to the plurality of conductors at a second end of each of the cables. The method also includes running the bundle between a first network interface and a location containing a plurality of network terminals. The method also includes running a portion of each cable through encountered obstacles and conduits and proximate to a respective network terminal.

The method also includes joining the first sub-component of each cable in conductive connection to a respective network component associated with the first network interface and joining the second sub-component of each cable in conductive connection to a respective second network component associated with each respective network terminal. The method also includes establishing a plurality of communication pathways between the first network interface and a plurality of network terminals.

Another aspect of the present invention is that the conductors are shielded copper wires. Another aspect of the present invention is that the conductors are optical fibers.

Another aspect of the present invention is that the sub-component is a wire guide. The method may also include joining each wire guide to a wire guide cap. The wire guide cap has conducting teeth. The method may also include contacting the conductors with the conducting teeth and forming a conductive connection between each wire guide and each wire guide cap.

Another aspect of the present invention is that the network components are RJ45 connectors and the sub-components are operatively connected to the RJ45 connectors.

Another aspect of the present invention is that the network interfaces are patch panels forming network hubs.

Another aspect of the present invention is that the network interfaces are a patch panel and a plurality network terminal devices.

Another aspect of the present invention is that the sub-components are adapted for reuse with a plurality of components.

These and various other advantages and features of novelty, which characterize the invention, are pointed out with particularity in the claims annexed hereto and forming a part hereof. However, for a better understanding of the invention, its advantages, and the objects obtained by its use, reference should be made to the drawings which form a further part hereof, and to accompanying descriptive matter, in which there are illustrated and described specific examples of an apparatus in accordance with the invention.

BRIEF DESCRIPTION OF THE DRAWINGS

Referring now to the drawings in which like reference numbers represent corresponding parts throughout.

Figure 1A:
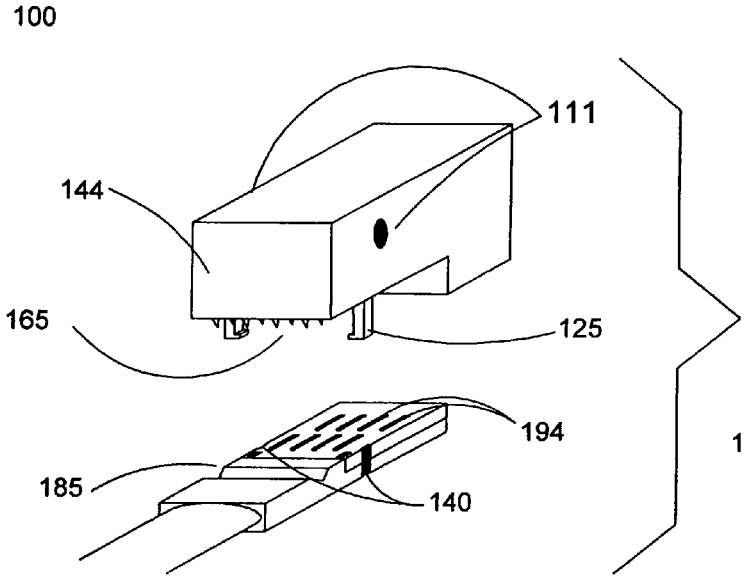
FIG. 1*a* and FIG. 1*b* illustrate a disassembled view of the wiring guide, cable, and connector according to an embodiment of the present invention.
Figure 1B:
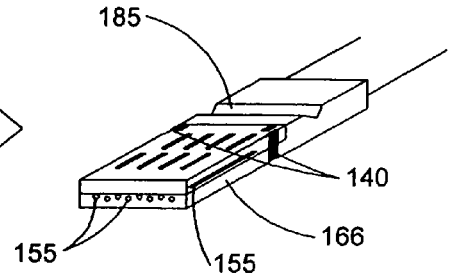
Figure 1C:
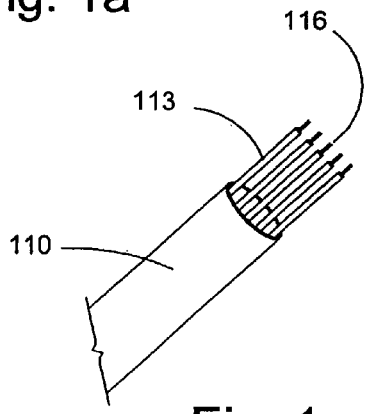
FIG. 1*c* illustrates a cable with conductors and sheath.

While the invention is amenable to various modifications and alternative forms, specifics thereof have been shown by way of example in the drawings and will be described in detail herein. It is to be understood, however, that the intention is not to be limited to the invention shown in the particular embodiments described. On the contrary, the invention is intended to cover all modifications, equivalents, and alternatives falling within the scope of the invention as defined by the claims appended hereto.

DETAILED DESCRIPTION OF THE INVENTION

In the following description of the illustrated embodiments, reference is made to the accompanying drawings which form a part hereof, and in which is shown by way of illustration, various embodiments in which the invention may be practiced. It is to be understood that other embodiments may be utilized, and structural and functional changes may be made without departing from the scope of the present invention. Corresponding reference numerals refer to corresponding components throughout.

The embodiments of the present invention provide prefabricated or factory installed network cables of predetermined lengths. The prefabricated cable sets have sub-component (connector-like termination) ends (or on at least one end if the cable is to be hard wired to a network component on one end). The pre-fabrication is preferably accomplished off site at a factory, but it could be done on site, probably by an automated machine. The key is elimination of mistakes in the assembly of the sub-component, which occurs routinely in the field.

While solving the first problem of mis-wired sub-components have the advantage of immobilizing the individual conductors within the sub-component and organizing them into a predetermined array or pattern of spatial relationship between each conductor. Then the sub-components are designed to be of such cross section that they can be routed through common paths in a typical cable run, which includes, channels and conduits found in walls, floors, ceiling and most importantly, furniture configured with wire guideways. By cross-section, it is meant, the narrowest point in the pass. In a cylindrical guideway, the inner diameter is the cross section, but in a rectangular guideway, the larger dimension of width or height may actually be the minimum cross section for purposes of cable routing since the sub-component is easier to design with a rectangular cross section than a cylindrical one. At bends or elbows, the mathematics become more complex because the length of the sub-component as well as the angle of bend must all be taken into consideration. Further purposes of this patent therefore, the smallest cross section, minimum cross section or other similar reference is defined as the size needed to pass through the narrowest point, or choke point of the passageway.

Typically such paths are too narrow for industry standard connectors (such as RJ-45 which is also referred to as the base connector) to be attached at the ends of prefabricated cables. Thus, by designing a compact sub-component, which could pass through such obstacles, be pre-tested for wiring continuity and pin-out accuracy (that the array of contact points on the termination are in a known and expected position, so that the mating base connector, usually with an industry standard output, will, invariably have the right signals on the correct conductors), the reliability of a network cabling installation will be vastly improved and likely to work on first try, with little or no reworking.

Finally, the prefabricated cables with small sub-components are re-usable. Since they can be installed through obstacles, they can be withdrawn as well for re-use.

A field installed wiring guide guides conductors into position for quality termination and crimp and provides strain relief for the wires or fibers and the outer sheath of the cable to create a quality cable or sub-cable assembly supporting termination at both ends of a cable. When the cable assembly is installed in a building facility, the wiring guide may be inserted into a cavity on a backside of a RJ45 female connector, completing termination of a station cable to the RJ45 female jack.

Female jacks may be inserted into a faceplate at a wall outlet or furniture partition outlet. A front end of the RJ45 female jack supports insertion of an RJ45 male connector into a front cavity of the RJ45 female jack. Another female jack at an opposing end of the cable may be inserted into a patch panel at a consolidation point, an ITR and/or an MTR.

The wiring guide is adapted to be small enough to fit through modular furniture wiring management, power poles and/or a ¼" or ½" electrical conduit. The wiring guide supports multiple connections. Multiple connections is defined herein as the ability to insert (install) and remove (de-install) the wiring guide from a backside cavity of an RJ45 female jack many times without damaging or compromising the wiring guide.

The wiring guide may alternatively be installed into a plastic housing creating an RJ45 male connector. The wiring guide may be utilized for multiple connections without damaging or compromising the wiring guide. The wiring guide supports universal attachment to either a male or female RJ45 connector.

The present invention provides an alternative to traditional cabling and existing zone cabling solutions through a pre-terminated zone cabling system.

The present invention minimizes additional up front cost to install a zone cable solution and eliminates field terminations resulting in a more consistent high quality connection (termination) of jacks at the workstation, the consolidation point distribution panel, the MTR, and the ITR.

The present invention also reduces labor costs to install zone cables (4 pair cables may be installed in bundles of 6 cables) with multiple setups on spools that are pre-manufactured to the exact length required to run from the MTR or the ITR to the consolidation point distribution panel. The labor costs are reduced because the cables may be pulled in multiple set ups and in groups of 6, 4 pair cables fastened together in a group. Further, no field termination is required because only insertion of the wire guide into the back cavity of the RJ45 female connector is required.

The present invention provides flexibility to quickly reconfigure an office or modular furniture area, reduces labor costs for future MAC's (because only approximately the last 25–75 feet of station cable requires reconfiguration), reduces material costs because the station cable (cable from consolidation point panel to workstation) may be used again and again. The present invention also provides marginally increased costs in making cable assemblies with a lower cost labor pool, but the increased production costs are offset by the higher labor cost savings associated with field technicians through reduced installation and termination time.

The present invention also provides manufacturer test results in the factory instead of or in conjunction with field testing, potentially resulting in time saved for field certification, and ensuring higher quality communication. The pre-terminated zone cabling system could be easily adapted to raised floor and ceiling cable solutions.

The present invention is a subassembly having a size small enough to overcome ordinary obstacles that occur in standard network cabling environments. The subassembly may be a wiring sub-component permanently attached to multi-wire cable in the factory. The sub-component may be adapted to operatively interface with a back portion of a standard electrical component of much larger size. The sub-component may be modular and of a size capable of successfully navigating small electrical conduits and in-wall wiring orifices. The sub-component may be adapted to increase the speed with which network wiring systems are connected by eliminating the need for splicing and crimping connectors to the end of cables during wiring installation, thus reducing costs of installation. The sub-component may also reduce environmental waste by providing reusable sub-cable assemblies that do not require cutting or modification before reuse.

In the following detailed description, some components are indicated repeatedly in successive drawings but have a number increased by one or more hundreds of a corresponding component in a prior drawing. For example, element 185 may appear as element 285, 385, 485 etc, in successive drawings without specific mention. In such case it should be a assumed that that component has a similar function to its lower numbered predecessor, unless otherwise stated.

FIG. 1*a*–1*d* illustrates a disassembled view of the wiring guide sub-component or assembly 166, cable 110, and wire cage cap connector 120 (FIG. 1*d*) according to an embodiment of the present invention. Cable 110 is shown having at least eight conductors, copper wires or optical fibers 116. Copper wires or other conducting wires 116 may be provided with shielding 113. The cable 110 may also be provided with shielding which may be stripped or peeled back revealing a portion of the conductors extending therefrom. The wires or fibers 113 are insertable into wire retaining grooves 155 of wire cage or guide 166.

Assembly is as follows: Cable 110 is inserted into wiring guide 166 position pairs 113 and conductors 116 into the proper grooves 155 which insures that the individual conductors are maintained in a predetermined spatial relationship to each other. Wiring cage or guide 166 is crimped at 185, as one way to immobilize the cable from losing that fixed spatial relationship between conductors. The crimp 185 utilizes cable outer sheath 110 to lock wiring guide 166 to wiring guide crimp 185. RJ45 Female cavity 165 wiring guide 166 locks into RJ45 cavity 165 by locking arms 125 which insert to lock in grooves 140 located on the wiring cage 166. These locking arms can release by pressing the release buttons 111 located on the RJ45F jack housing 144, which spread arms 125 by means known to a person skilled in this art.

In the embodiment shown, eight (8) grooves 155 are provided in a generally parallel arrangement to retain the eight conductors 113 in the wire guide 166, however the wire guide may be provided with any number of grooves, as desired. The grooves 155 shown are provided with detents (i.e. slight narrowing of the open face of the groove relative to the base of the groove so that the conductors can move longitudinally, in or out, but not laterally, out of the grooves.) This will also allow the wire to be snapped into the groove and be retained and spatially immobilized by the narrowing of the gap) along the upper edge to hold and retain the conductors 113 along the length of the grooves 155. When the conductors 113 have been inserted into the wire guide 166, the conductors 113 may be secured from removal by a crimp 185 to sheath 110. The connector cap 120 may also be provided with a complementary engagement latch that may interlock with a corresponding complementary engagement latch 135 of the wire guide 166.

In the embodiment shown, the female RJ45 connector 144 is provided with a pair of arms or prongs 125 adapted to be inserted into lock in groves 140 on the wire guide 166. In addition the wiring guide cap 120 and outer sheath crimp 185 preventing removal of the conductors 113 from the wire guide 166. Although one embodiment of connector sheath has been disclosed other types of connector assemblies may be provided to secure the conductors 113 to the wire guide 166.

Cap 120, in this embodiment includes conducting points 194 on its top side and teeth or spears 184 on the bottom side. The spears will engage or pierce the conductors in grooves 155 to make electrical or optical connection between the cable 110 and connector 144, to complete the signal path.

Figure 1D:
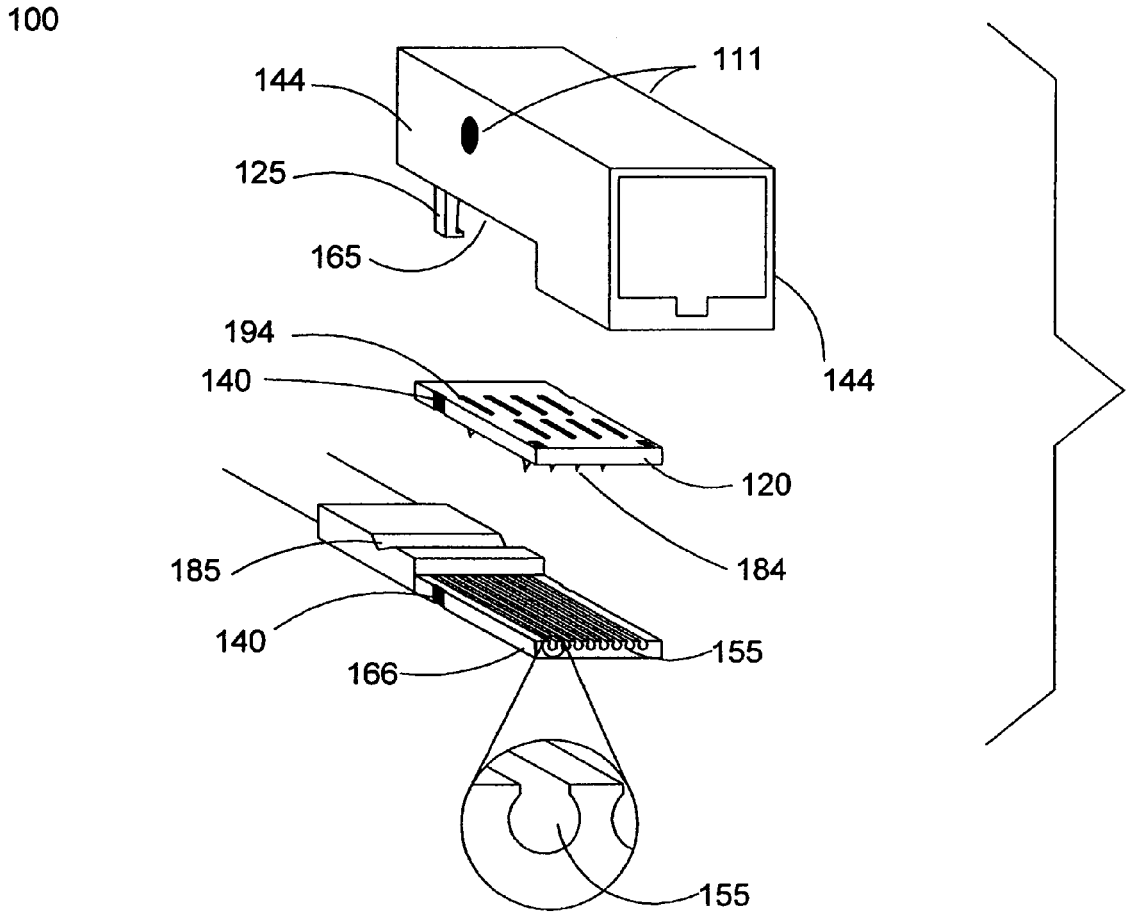
FIG. 1*d* illustrates an exploded view of the subject matter in FIG. 1*a;*
Figure 2:
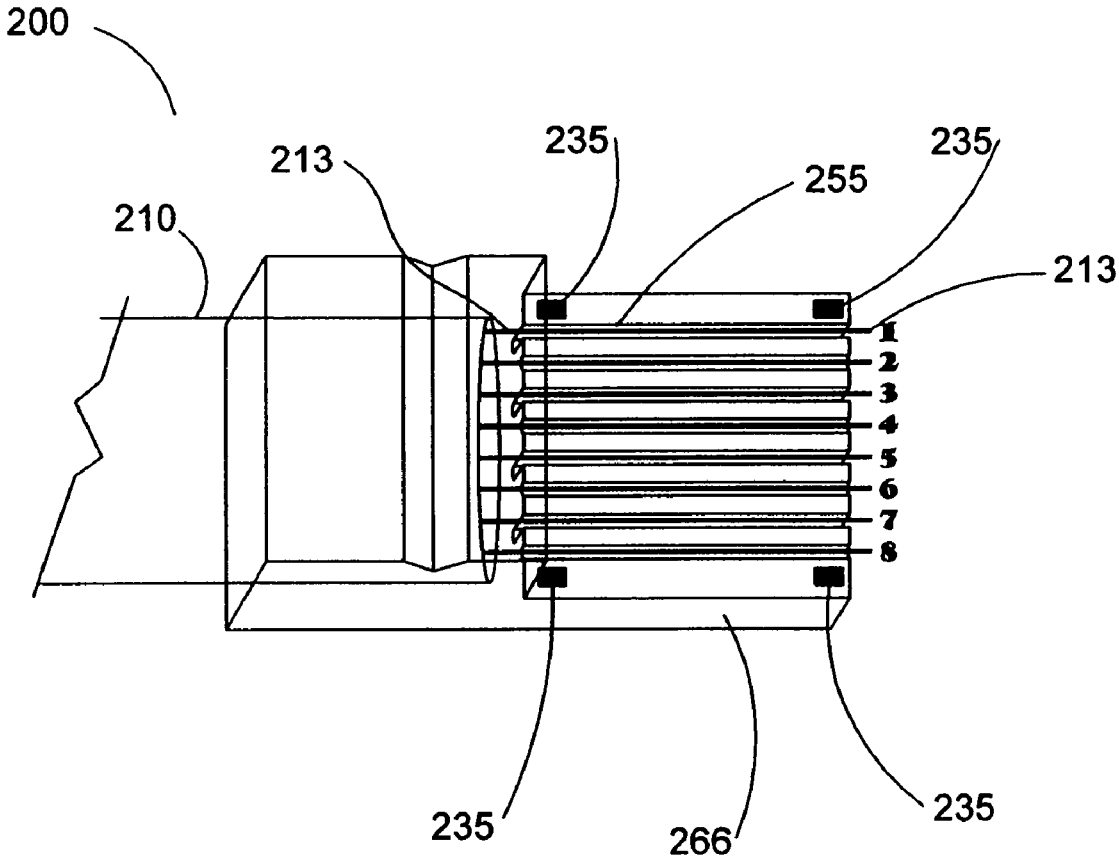
FIG. 2 illustrates an assembled view of the wiring guide with wires connected therethrough and with the connector removed therefrom the according to another embodiment of the present invention.

FIG. 2 illustrates an assembled top view 200 of the wiring guide 266 with conductors 213 connected therethrough and with the connector sheath removed therefrom the according to another embodiment of the present invention. In FIG. 2, the conductors 213 extending from cable 210 are shown retained in grooves 255 in wire guide 266. Grooves 255 are shown provided in an upper surface of the wire guide 266. The grooves 255 run parallel at various depths as was shown in FIG. 1*a*–*d* and provide access for electrically conducting teeth 184 in FIG. 1*d* and 584 in FIG. 5 as shown. When the wiring guide 266 is inserted into an RJ45 connector according to an embodiment of the present invention, the electrical or light conducting teeth penetrate the conductors 213 placed in the grooves 255 and the grooves 255, contacting the conductors 213, and providing conduction of electrical current or optical signals therebetween.

Figure 3:
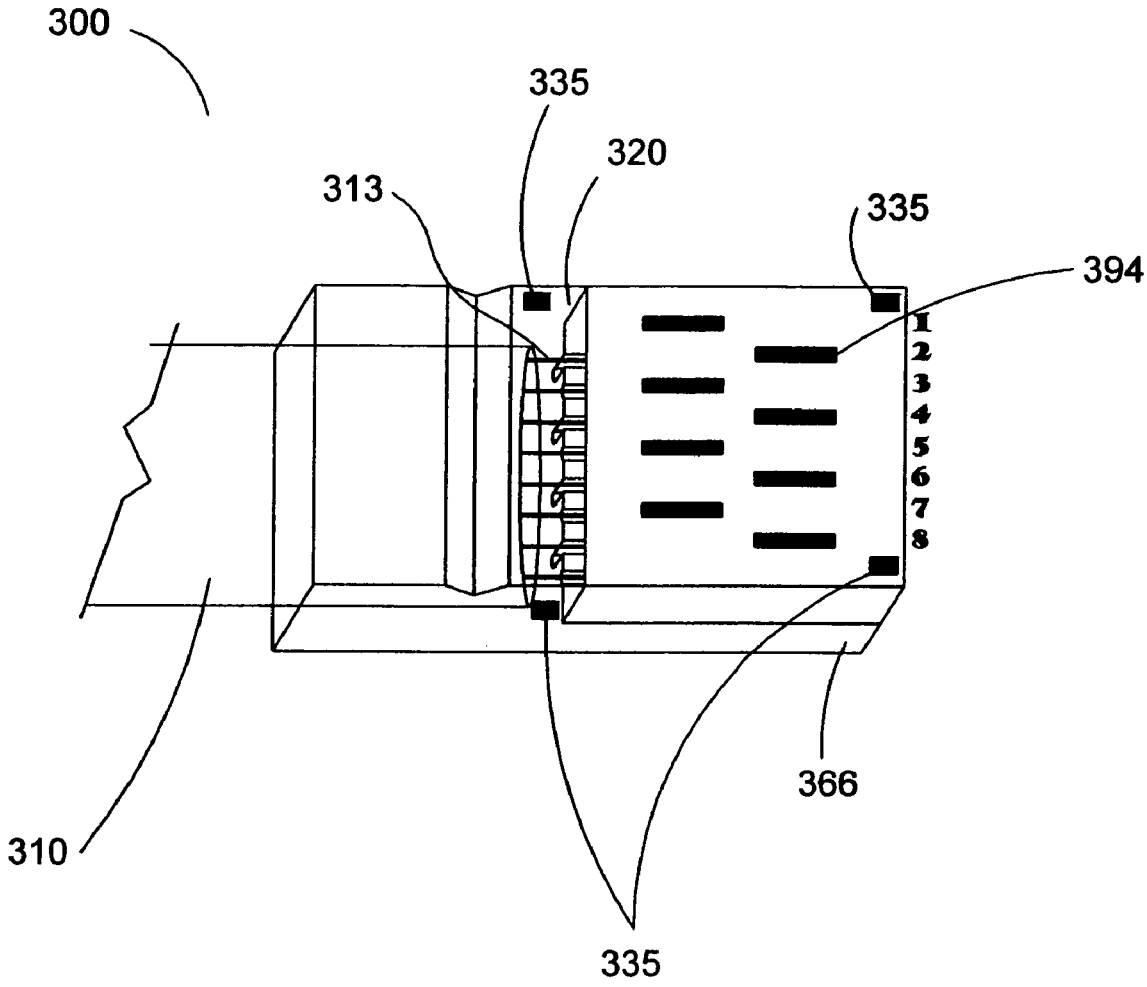
FIG. 3 illustrates an assembled view of the wiring guide with wires connected therethrough and a connector securing the wires into the wire guide according to another embodiment of the present invention.

FIG. 3 illustrates an assembled view 300 of the wiring guide 366 with conductors 313 connected therethrough and a connector cap 320 securing the conductors 313 into the wire guide 366 according to another embodiment of the present invention. In FIG. 3, the conductors 313 from cable 310 may be frictionally secured to the wire guide 366 via engagement between complementary surfaces in the connector cap 320 and wiring guide 366.

Figure 4:
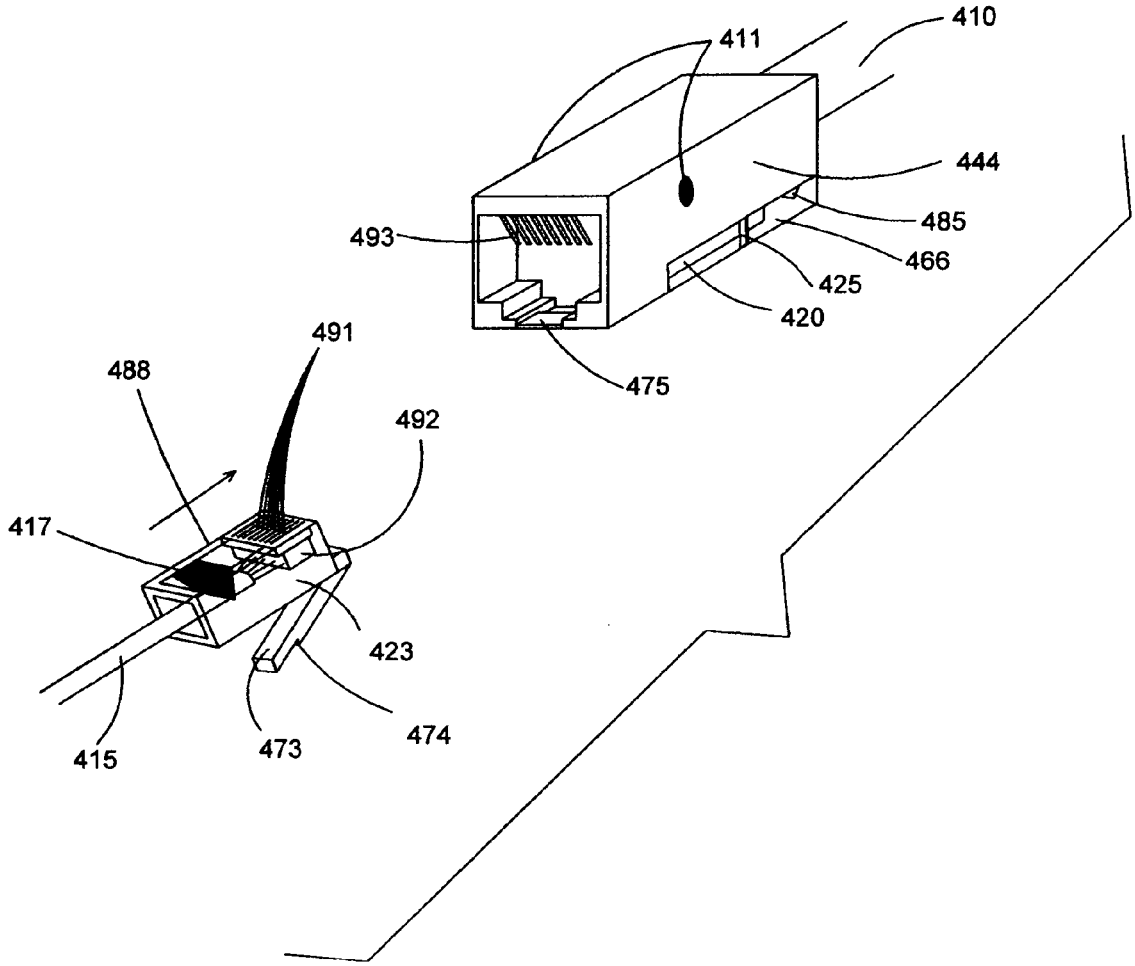
FIG. 4 illustrates a front side of an RJ45 female connector and an RJ45 male connector for insertion therein according to another embodiment of the present invention.

FIG. 4 illustrates a disassembled view 400 of a front side of an RJ45 female connector 444 and an RJ45 male connector 488 for insertion therein according to another embodiment of the present invention. In FIG. 4, the RJ45 male connector 488 is shown provided with electrodes or light conductors 491. The conductors 491 of the RJ45 male connector 488 make operative contact with corresponding electrodes or light conductors 493 inside RJ45 female connector 444 when the male connector 488 is inserted into female connector 444.

The RJ45 male connector 488 is shown for visual convenience, fabricated of a transparent plastic to reveal the components therein. However, the male connector and the female connector may each be fabricated of any hard non-conducting material. A cable 415 encapsulating at least 8 conductors 423 is inserted into a rear portion of the male connector 488.

A wedge shaped crimp 417 is inserted to securely retain the cable within the male connector 488.

A conducting member 492 provides operative connection between the conductors 423 and the electrodes 491. The male connector 488 is provided with a flexible clip member 473 having a flange portion 474.

When the male connector 488 is inserted into the female connector 444, the flange portion 474 interlocks with a corresponding flange member 475 inside the female connector 444 to removably secure the male connector 488 into operative connection with the female connector 444 and ensuring that operative electrical or optical connection occurs between male electrodes 491 and female electrodes 493.

Figure 5:
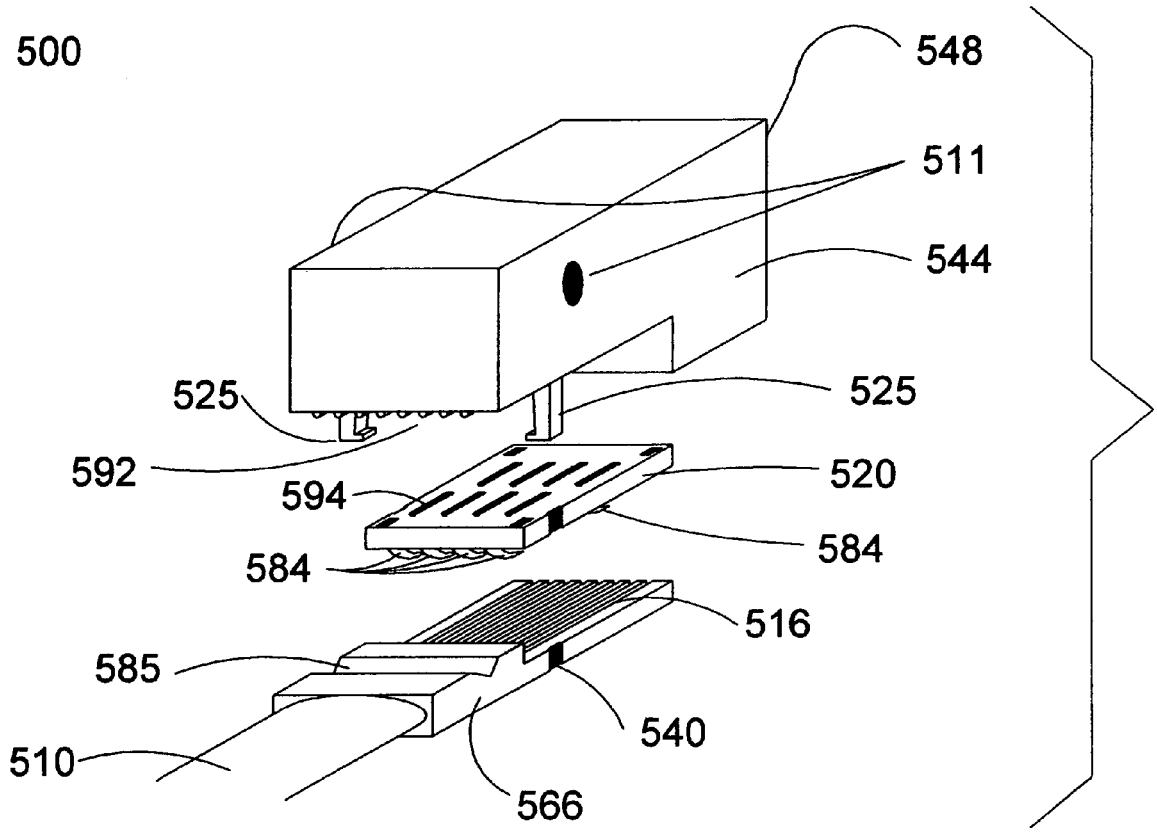
FIG. 5 illustrates a backside of an RJ45 connector, a wire guide, and a wire guide cap disassembled according to another embodiment of the present invention.

FIG. 5 illustrates a backside of an RJ45 Female connector 544, a wire guide 566, and a wire guide cap 520 disassembled according to another embodiment 500 of the present invention. In FIG. 5, the conductors 516 extending from cable 510 are shown inserted into the wire guide 566 and may be frictionally secured therein by a crimp 585 to the outer cable 510 sheath. Connector contacts or pins 594 are shown provided in an upper surface of the wiring guide cap 520 place upon and locked into the wire guide 566 for connection of the wiring guide 566 to the wiring guide cap 520 exterior to the RJ45 connector 544. The connector pins 594 wiring guide 566 and wiring guide cap 520 provide access for electrically or light conducting tooth or light conducting teeth 584 of the wiring guide cap 520 to operatively and conductively contact the conductors 516 inside the wiring guide 566. The wiring guide 566 and connected wiring guide cap 520 when joined together may be inserted into the RJ45 connector 544 providing conduction of electrical current or optical signals therebetween.

Once connected together, the wiring guide 566 and the wiring guide cap 520 may be inserted into the RJ45 connector 544 wherein contact electrodes 594 situated on a top portion of the wiring guide cap 520 are placed in operative and conductive contact with corresponding RJ45 electrodes 592 facilitating conduction of light or electrical signals to the RJ45 connector 544. The combination wiring guide 566 and wiring guide cap 520 when inserted into the RJ45 connector 544 are releasable engaged therein via release lock buttons 511. When fully assembled, a male RJ45 cable may be inserted into the front side 548 of the RJ45 connector 544 to complete the cabling solution. Notice that pin 594 generally make a piercing connection (in copper) thereby making the contact between elements 520 and 516 a permanent (one time) connection whereas the connection between contacts 594 and 592 are reusable if the cable must be rerouted.

Figure 6:
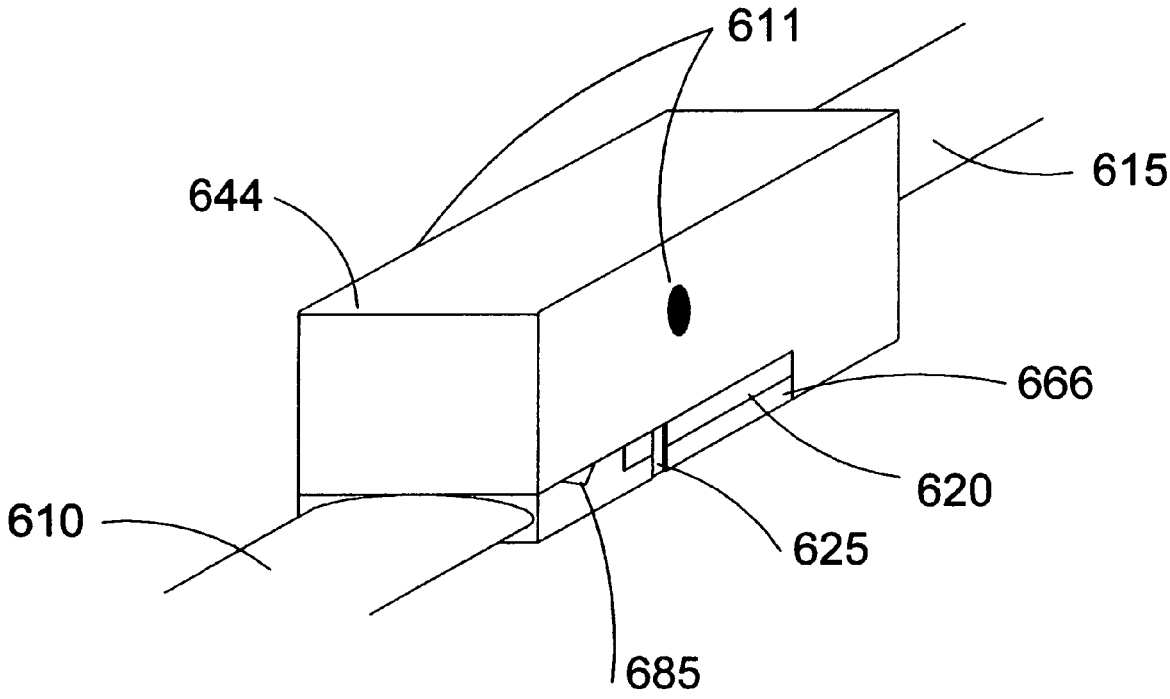
FIG. 6 illustrates a backside of an RJ45 connector having an assembled wire guide inserted and secured therein according to another embodiment of the present invention.

FIG. 6 illustrates an assembled view 600 of a backside of an RJ45 connector 644 having an assembled wire guide 666 inserted and secured therein according to another embodiment of the present invention. In FIG. 6, the RJ45 female connector 644 is shown fully assembled with cable 615 connected to a male RJ45 connector exiting the front side (not shown) and the wire guide 666 fully inserted into the backside of the female connector 644. Conductors 613 are shown exiting cable 610 and entering the interface between the wire guide cap 620 and the wire guide 666 and entering into the grooves 655 therebetween. The conductors 613 are in operative connection with electrodes 694, which in turn conduct electrical or optical signals through the conductors of male/female RJ45 connector (not shown) and on to cable 615. Tab 625 is shown engaging and securing the wire guide 666 into the female connector 644.

Figure 7:
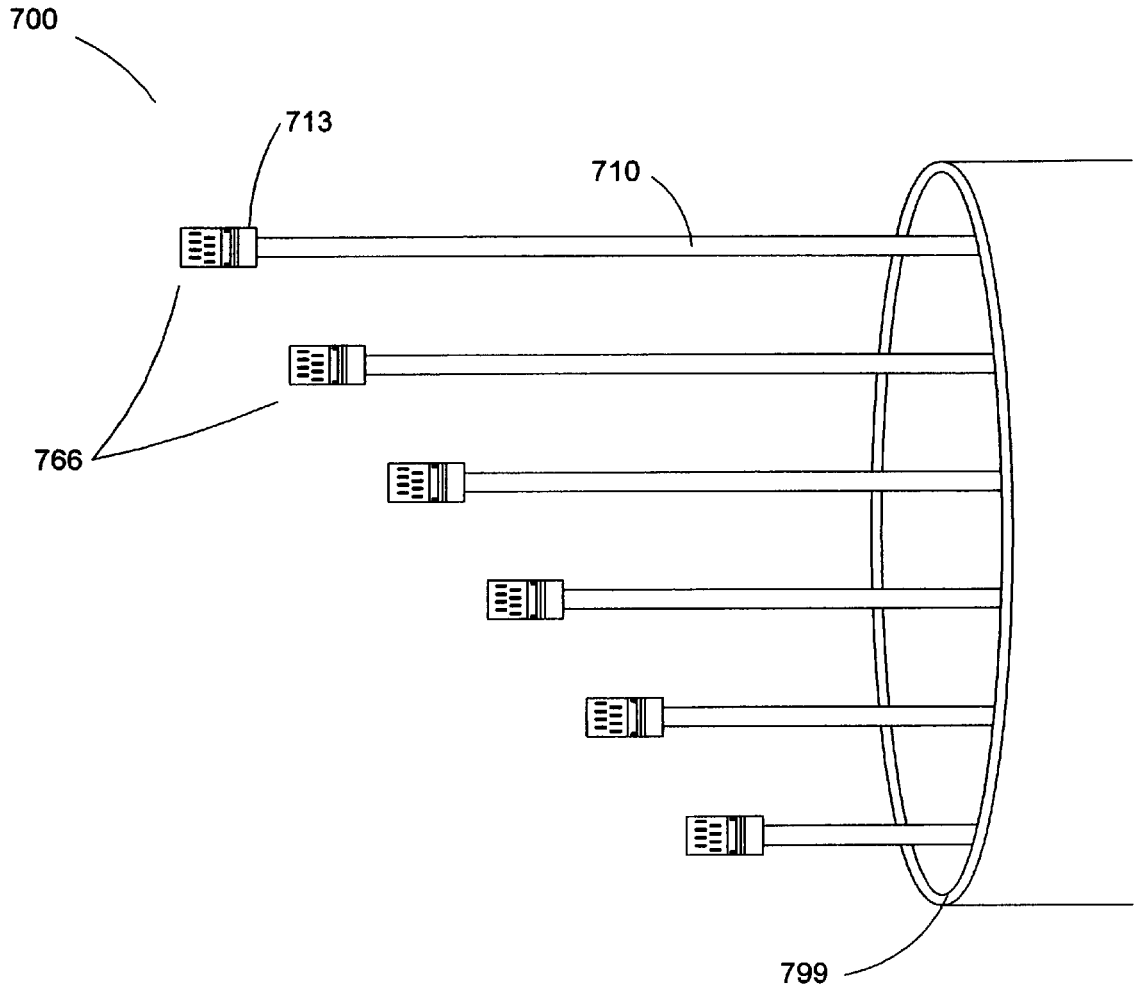
FIG. 7 illustrates a prefabricated bundle of cables with each cable having a wire guide pre-attached to the end of the cable for providing a zone cabling system according to another embodiment of the present invention.

FIG. 7 illustrates a view 700 of a prefabricated bundle 799 of cables 710 with each cable having a wire guide 766 or sub-component pre-attached to the end of the cable 710 for providing a zone cabling system according to another embodiment of the present invention. In FIG. 7, a plurality of cables 710 are provided for making a plurality of connections between and MTR and an ITR, or an ITR and a consolidation point, or between a consolidation point and a plurality of workstations. While a bundle of six cables is shown in FIG. 7, the invention is not limited to only six cables and bundles having any desirable number of cables are within the ambit of the invention. The cables may be of the same overall length but they are offset from each other sufficiently that no wire guide or sub-component overlaps at any point on the cable (i.e., no point along the cable bundle are there two sub-components at the same point along the bundle's longitudinal extent or axis defined by its length). This makes pulling the cable bundle through obstacles much easier as the bundle is inherently of small cross section. Of course, this offsetting technique also insures that no sub-component contacts another subcomponent of an adjacent cable, whereby the bundle is maintained with the smallest possible cross section.

Figure 8A:
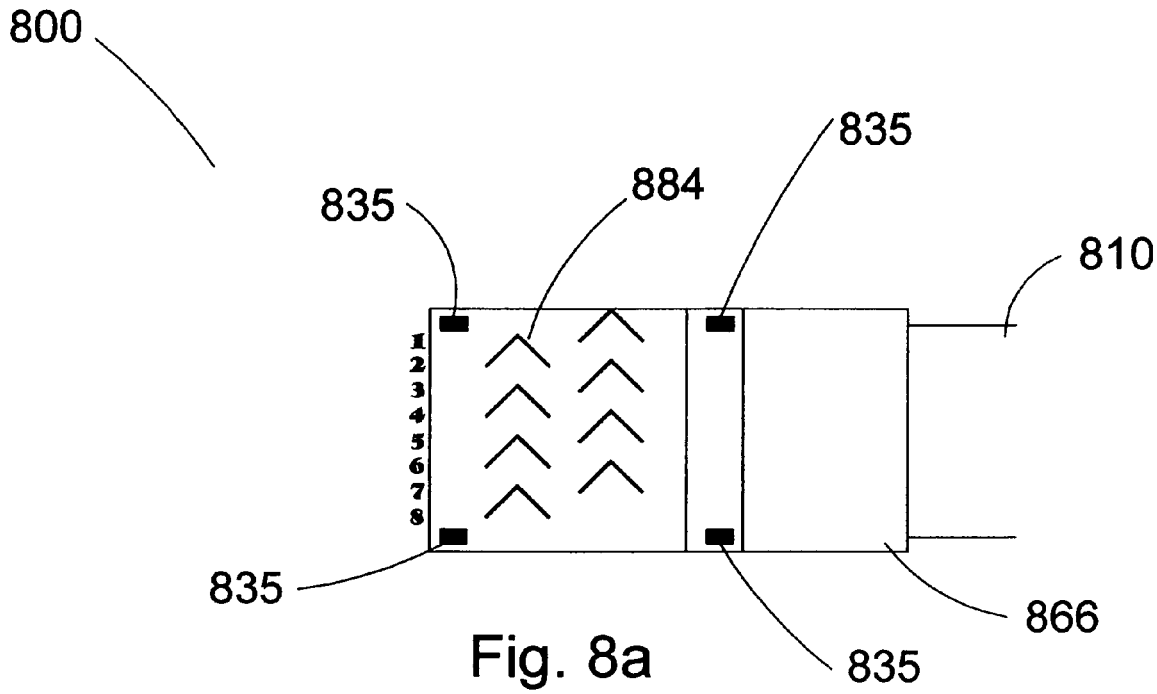
FIGS. 8*a*–8*c* illustrate an exploded view of the RJ45 connection apparatus according to an embodiment of the invention according to the embodiment in FIG. 5.
Figure 8B:
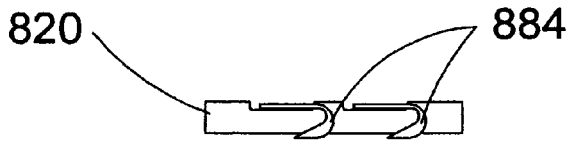
Figure 8C:
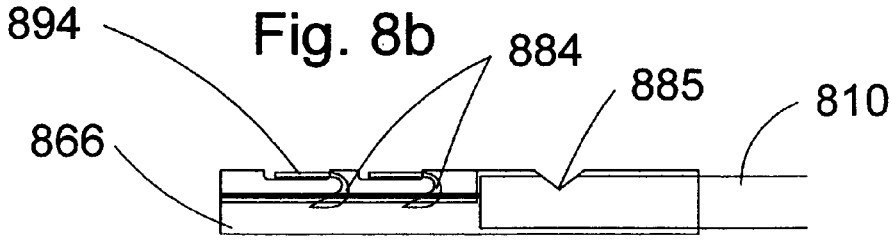

FIGS. 8*a*–8*c* illustrate an exploded view of the RJ45 connection apparatus according to an embodiment of the invention according to the embodiment in FIG. 5 with the hemispherical spears 884 more clearly shown.

Figure 9:
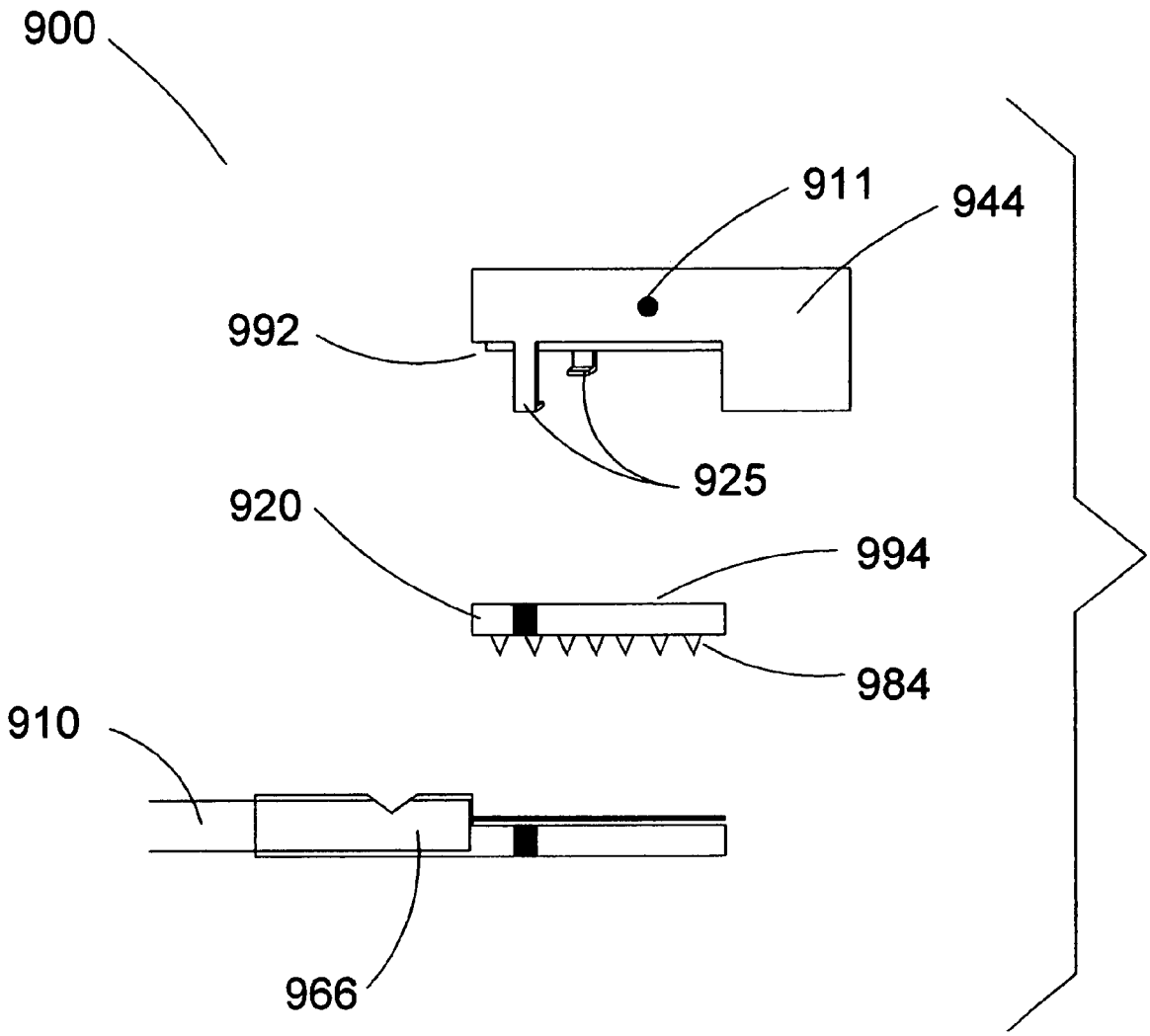
FIG. 9 illustrates another exploded view of the RJ45 connection apparatus according to an embodiment of the invention show in FIG. 1*d*.

FIG. 9 illustrates another exploded view of the RJ45 connection apparatus according to an embodiment of the invention show in FIG. 1*d* with triangular-shaped teeth 984 clearly shown.

Figure 10A:
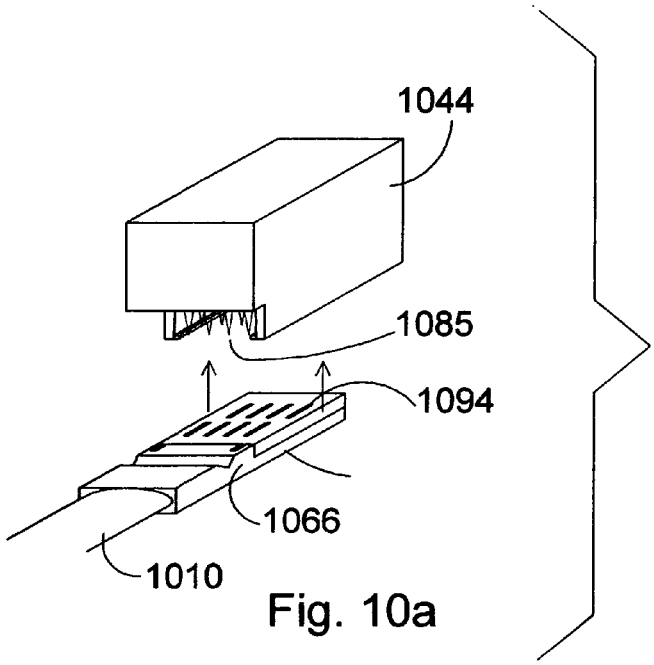
FIGS. 10*a*–10*c* illustrates another embodiment with the teeth moved to the base connector.
Figure 10B:
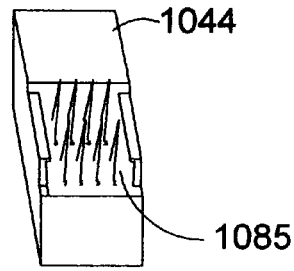
Figure 10C:
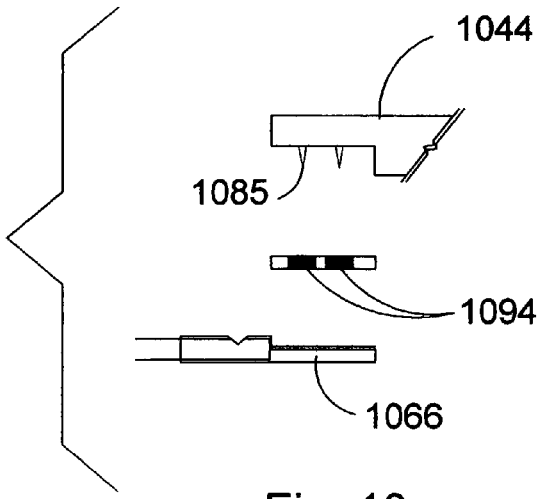

FIG. 10*a*–10*c* illustrates an embodiment different from FIG. 5 in this respect: FIG. 5 shows cap 520 having teeth or spears 584 which engage the conductors 516 in the guide 566. In FIG. 5 the cap has contact points 584. An alternative is to move the teeth 1085 to the base RJ45 connector 1044 and instead of contact points (as in 584) an array of apertures 1085 are provided in the cap 1066. Therefore, in this configuration, there is no intermediate electrical or optical contact in the cap. The connection is made directly at time of connection between the guide 1066 and the base connector 1044, when the teeth 1085 engage the conductors of the cable 1010 directly. This makes for simpler design but makes multiple re-use of the cables less practical since they must be re-pierced every time they are connected to a new base connector.

It is understood that alternate structures for the present zone cabling invention may be provided without departing from the scope of the invention. In a preferred embodiment of the present invention, pre-terminated zone distribution components may include data wiring room components, such as a free standing rack, 24 to 48 port patch panel wiring management and patch cables. Consolidation point enclosure components may include a box enclosure plenum rated, a feeder termination panel supporting multiple 6-4 pair 24 AWG from Category 6 cables from ITR, a station termination panel supporting multiple 1-4 pair 24 AWG Category 6 cable from workstation to CP and patch cords.

A zone feeder cable pre-terminated may include 6-four pair Category 6 plenum or PVC cables bundled and 6-four pair Category 6 cables in plenum sheath. The station cable pre-terminated may include 1-four pair Category 6 cable pre-terminated. The station office/workstation components may include a faceplate. The components of the zone cabling solution may include a 4 pair bundled cable, 6-four pair Category 6 cables bundled together with each cable being numbered or a different color or a Category 6, 25 pair cable, divided into four pair increments with each four pair glued together or sheathed together, and where each four pair is numbered on both sides.

The cables are preferably terminated on both sides with wire guides, and not with RJ45 connectors. The cable assemblies may be pre-manufactured and ordered in any lengths (preferably 75 feet to 275 feet, in increments of 25 feet.) Each cable in the bundle or sheath may be extended a distance at least as great as the length of the wire guide (about 1½ inches) so that the first cable is the length ordered with each additional cable increasing by 1½ inches per side. This will create a bundle of minimum diameter.

Patch panels may come blank or may be equipped with the RJ45 connectors, or other types of connectors, less the wire guide assembly. The patch panels may be mounted on a standard rack. The patch panels may support the RJ45 connectors, or other connectors, at a 45-degree angle (sideways).

Consolidation point box enclosures may be installed in the ceiling or in raised flooring. The boxes may support patch panels within a ceiling accessed box requiring a swing bracket to lower the enclosure box to install cables and patch cables.

The cables may be utilized from the wall or furniture faceplate to the consolidation point enclosure box. The cables may be pre-manufactured on spools and come in 2 fixed increments (such as 25-foot increments starting at 25 feet up to 300 feet in length). The cables may be pre-terminated with the wire guide assembly pre-attached on both ends of the cable. The cables may come in various lengths and may be pre-terminated (pre-manufactured).

The foregoing objects, advantages and distinctions of the invention, among others, are obtained in a presently preferred construction that at least provides a wire guide subassembly having a size small enough to overcome ordinary obstacles that occur in standard network cabling solutions. The subassembly may be a wiring sub-component pre assembled and permanently attached to multi-wire cable in the factory. The sub-component may be adapted to operatively interface with a back portion of a standard electrical component of much larger size.

The sub-component may be modular and of a size capable of successfully navigating small electrical conduits and in-wall wiring orifices. The sub-component may be adapted to increase the speed with which network wiring systems are connected by eliminating the need for splicing and crimping connectors to the end of cables during wiring installation, thus reducing costs of installation. The sub-component may also reduce environmental waste by providing reusable sub-cable assemblies that do not require cutting or modification before reuse.

The foregoing description of an exemplary embodiment of the invention has been presented for the purpose of illustration and description. It is not intended to be exhaustive or to limit the invention to the precise form disclosed. Many modifications and variations are possible in light of the above teaching. It is intended that the scope of the invention not be limited with this detailed description, but rather by the claims appended hereto.

What is claimed is:

1. A reusable connector for use with a female RJ style jack, the reusable connector for connection to the ends of twisted pair conductors in a twisted pair cable and also for connection to the side of the RJ style jack opposing the female RJ style connection such that the RJ style jack is established in electrically conductive relation with the twisted pair conductors, the reusable connector, said RJ style jack having a plurality of electrodes, the reusable connector comprising;

a base element having a plurality of conductor receiving receptacles for maintaining twisted pair conductors in a substantially fixed spatial relationship to each other;

a second element, having conductive elements, for engaging said conductors and immobilizing them from being withdrawn from said conductor receiving receptacles; the conductive elements having piercing members capable of piercing the conductors for conducting signal from the conductors to the conductive elements;

the conductive elements of the second element being aligned such that they engage the plurality of electrodes on the RJ style jack when the second element is brought together with the RJ style jack; and locking members on said connector for maintaining said cap in intimate engagement with said RJ style jack; and in which the reusable connector is adapted to be connected to the RJ style jack by movement in a direction substantially at a right angle to a long axis of the conductors.

2. The reusable connector as claimed in claim 1, further comprising a strain relief securable to the twisted pair cable.

3. The reusable connector as claimed in claim 1, in which the base element and the second element joined together are dimensioned to pass through a twelve millimeter conduit.

4. The reusable connector as claimed in claim 1, in which the base element and the second element joined together are dimensioned to pass through a six millimeter conduit.

5. The reusable connector as claimed in claim 1, further comprising a cap and in which the conductive elements pass through apertures in the cap and pierce the conductors to make electrical and mechanical connection.

6. The reusable connector as claimed in claim 1, in which the second element comprises a substantially planar plate of nonconductive material having a first side and a second side pierced by the conducting elements tat align with the plurality of grooves on the first side.

7. The wiring cage as claimed in claim 1, in which the conductor receiving receptacles defined by the base element are substantially cylindrical in shape and having an opening substantially parallel to a long axis of the cylinder, the opening being narrower than a diameter of the cylinder shape.

8. A reusable connector for use with a female RJ style jack, the reusable connector for connection to the ends of twisted pair conductors in a twisted pair cable and also for connection to the back side of the RJ style jack such that the RJ style jack is established in electrically conductive relation with the twisted pair conductors, said RJ style jack having a plurality of electrodes, the reusable connector comprising;

a base element having means for maintaining twisted pair conductors in a substantially fixed spatial relationship to each other;

a second element, having conductive means for engaging said conductors and means for substantially immobilizing the conductors from being withdrawn; the conductive means having means for piercing the conductors for conducting signal from the conductors to the conductive means;

conductive elements of the second element being aligned such that they engage the plurality of electrodes on the RJ style jack when the second element is brought together with the RJ style jack; and means for locking on said connector to maintain intimate engagement with said RJ style jack; and in which the reusable connector is adapted to be connected to the RJ style jack by movement in a direction substantially at a right angle to a long axis of the conductors.

9. The reusable connector as claimed in claim 8, further comprising means for strain relief securable to the twisted pair cable.

10. The reusable connector as claimed in claim 8, in which the base element and the second element, when assembled, are dimensioned to pass through a twelve millimeter conduit.

11. The reusable connector as claimed in claim 8, in which the base element and the second element, when assembled, are dimensioned to pass through a six millimeter conduit.

12. The reusable connector as claimed in claim 8, further comprising a cap and in which the conductive means passes through apertures in the cap and pierces the conductors to make electrical and mechanical connection.

13. The reusable connector as claimed in claim 8, in which the second element comprises a substantially planar plate of nonconductive material having a first side and a second side pierced by the conducting elements that align with the plurality of grooves on the first side.

14. The reusable connector as claimed in claim 8, in which the means for substantially immobilizing defined by the base element are substantially cylindrical in shape and have an opening substantially parallel to a long axis of the cylinder, the opening being narrower than a diameter of the cylinder shape.

* * * * *